United States Patent [19]

Latasiewicz

[11] Patent Number: 4,551,586

[45] Date of Patent: Nov. 5, 1985

[54] MULTIPLE CONTACT LAYER MEMBRANE SWITCH

[75] Inventor: Leonard Latasiewicz, Hoffman Estates, Ill.

[73] Assignee: Motorola, Inc., Schaumburg, Ill.

[21] Appl. No.: 621,987

[22] Filed: Jun. 18, 1984

[51] Int. Cl.[4] ..... H01H 3/12

[52] U.S. Cl. ..... 200/5 A; 200/159 B

[58] Field of Search ..... 200/159 B, 5 A

[56] References Cited

U.S. PATENT DOCUMENTS 4,345,119 8/1982 Latasiewicz ..... 200/159 B

FOREIGN PATENT DOCUMENTS 2100517A 12/1982 United Kingdom ..... 200/159 B

*Primary Examiner*—A. D. Pellinen

*Assistant Examiner*—Morris Ginsburg

*Attorney, Agent, or Firm*—Donald B. Southard; Steven G. Parmelee

[57] ABSTRACT

A membrane switch is provided having at least two surfaces having contact members thereon. Such contact surfaces can be applied to different layers of the switch assembly or to both the top and bottom surfaces of the same layer of the switch assembly. Certain of the contact members of the different surfaces are in registration with each other and are of such a configuration to permit the combined contact of such members with a base layer.

20 Claims, 6 Drawing Figures

MULTIPLE CONTACT LAYER MEMBRANE SWITCH

BACKGROUND OF THE INVENTION

The present invention relates generally to membrane switches and, more particularly, to a multiple layer membrane switch having at least two surfaces having contact members thereon.

Known membrane switches comprise two or more layers of flexible plastic. Such switches are normally employed in the touch control panels or keyboards of devices such as microwave ovens and computers. Normally a top layer of flexible plastic is provided having indicia thereon to identify the particular function of each switch area. A second layer is provided adjacent the top layer and includes contact members in registration with the particular indicia. In registration means that the particular indicia and its corresponding contact member are in two dimensional alignment. Pushing on or compression of the flexible layer at or near the indicia causes a flexing or movement of the second layer at or near the contact member. Usually a spacer layer is provided adjacent the second layer, with the spacer layer having apertures in registration with the contact members of the second layer. Such spacer layer usually comprises a type of foam membrane such as disclosed in U.S. Pat. No. 4,345,119. A fourth layer is provided adjacent the spacer layer. Such fourth layer usually comprises the grounded metal chassis of the particular device in which the membrane switch is being utilized. Upon the compression of the flexible indicia and resulting movement of the contact member of the second layer, contact is made between the contact member and the ground layer, thereby completing the particular switch circuit associated with the contact. The contact members of the second layer are connected to a series of leads extending from the switch assembly.

Another membrane switch arrangement that is known comprises an indicia bearing top layer of a flexible plastic material. A second layer of flexible plastic is provided adjacent the top layer. The second layer contains contact members in registration with particular indicia of the top layer. A spacer layer is provided adjacent the second layer and having apertures in registration with the contact members of the second layer. A fourth non-conductive layer is provided having contact members in registration with certain of the second layer contact members. Upon the compression of an indicia bearing area of the top layer, the contact member of the second layer in registration therewith is flexed so as to make connection between the contact area of the second layer and the contact area of the fourth layer in registration therewith. Each of the second layer contact members and the fourth layer contact members are connected to a series of leads which extend from the switch assembly.

The main limitation of the above described arrangements are that they provide for a single circuit connection. In the arrangement wherein the contact members are shorted against the ground layer, a single layer of external leads extends from the contact member layer. Even in the arrangement where two sets of leads extend from the two layers of contact members, only a single layer of connections is formed upon the connection of the contact members of the one layer with the contact members of the second layer. The connection possibilities are limited to the connection of a contact member on the one layer to a contact member on the ground or other layer.

In changing the graphics or design of a control panel, it is extremely difficult to change the switch arrangement adjacent such graphics without changing the printed circuit board to which the switch leads are attached. The reason for such difficulty is that the repositioning or addition of graphics requires the repositioning of contact members so that the leads may extend to the same positions on the circuit board, as it is desirable to utilize the same proven design of circuit board to control the various functions of the device to which it is connected. The connection of the leads to the same positions of the circuit board, without utilizing undesirable cross-overs, becomes an extremely difficult task when only one layer of switches is available for contact with the newly arranged indicia. Even when two separate layers include contact members, the switch connection possibilities are limited to the connection of contact members on one layer to contact members on the other layer.

Accordingly, it is an object of the present invention to provide an improved membrane switch assembly by utilizing multiple contact bearing surfaces.

SUMMARY OF THE INVENTION

The present invention provides a membrane switch assembly having a plurality of contact bearing layers. Each such contact bearing layer contains a plurality of contact members connected to a plurality of leads which extend from the switch assembly. In the arrangement of the switch assembly, the contact members are placed as desired in registration with each other or with apertures in spacer layers. Such arranging of the switch assembly permits contact between desired contact members themselves, between desired contact members and a base ground layer or between individual contact members and the base layer. Such a switch assembly provides a great number of possible combinations of contact members which enables such a switch assembly to be readily adapted to a number of control patterns as dictated by the switching requirements of the desired indicia function on the top layer of the switch assembly.

A membrane switch assembly in accordance with the present invention includes a top layer of flexible plastic usually bearing some indicia of desired control switching functions. Two or more layers are adjacent to the top layer. Certain of such layers include contact members on at least one side thereof. Such contact members on each layer are connected to a plurality of leads extending from the switch assembly. A base layer is provided which is usually a ground contact layer. Spacer layers are provided as needed to keep adjacent contact members from contacting each other, i.e., a normally open condition. When it is desired to perform the switching desired to accomplish an indicated function, the top layer area bearing the desired indicia is compressed, usually by the finger pressure of an operator. Such compression causes the flexing of the top layer in the area of the indicia. Layers bearing contact members in registration with the area of the compression will also be compressed. Depending on the design of the switch assembly, the contact members will contact each other or each other and the base layer or else a specific contact member will contact the base layer alone. Such a switch arrangement provides a large number of possible switching functions to accommodate a wide variety of top layer indicia switching requirements. Accordingly, the switch assembly permits great flexibility in matching leads with desired indicia functions so that the appropriate leads can be connected to the printed circuit board to accomplish the desired control function.

One application for such an indicia assembly is in the control panel of a microwave oven. Information is inserted into the memory of a microprocessor by touching the various indicia in the required order. This closes switches associated with such indicia.

In particular, the present invention provides a membrane switch assembly comprising a flexible first layer, a second layer having a plurality of contacts, a third layer having a plurality of contacts, certain of said third layer contacts being in registration with at least a portion of said second layer contacts, and a fourth layer having at least one contact area, certain of said third layer contacts being of a configuration so as to permit contact between each such third layer contact, the second layer contact in registration therewith and the fourth layer contact area when the area of said flexible first layer in registration with said second and third layer contacts is compressed.

DESCRIPTION OF THE PREFERRED EMBODIMENT

Figure 1:
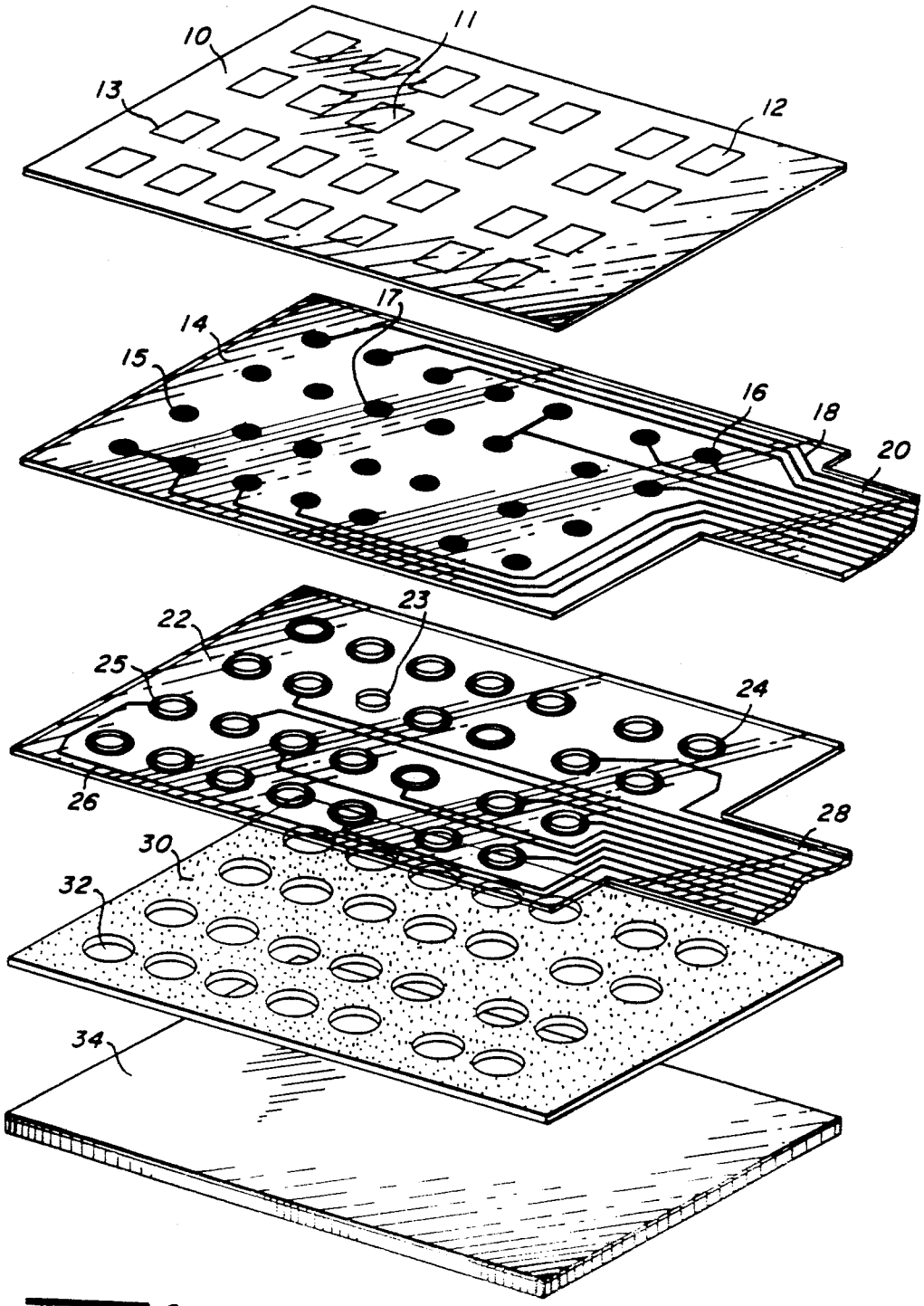
FIG. 1 is an exploded view of a switch assembly in accordance with the present invention.
Figure 2:
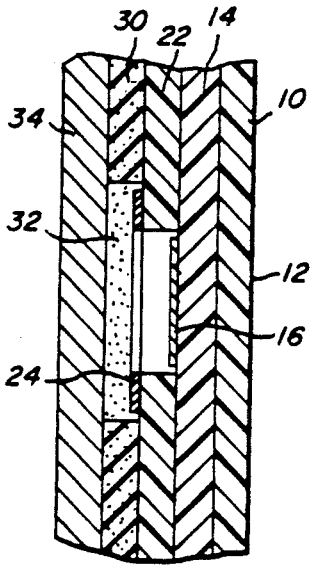
FIG. 2 is a cross section view of a portion of the assembled switch embodiment of FIG. 1.

Referring now to FIGS. 1 and 2 of the drawings, a membrane switch assembly comprising a first embodiment of the present invention is shown. A first flexible plastic layer 10 is shown comprising several indicia 12. Such indicia identify the switch function that will be accomplished by the pressing of that area of layer 10.

A second layer 14 of flexible plastic is adjacent first layer 10. Second layer 14 carries a printed pattern of contact areas 16 on its lower surface. These contact areas are usually formed by a screen printing operation and comprise a graphite composition in a vinyl binder. Contact areas 16 comprise one portion of a normally open switch and are joined by conductors 18 in a pattern which is designed to perform a switching function for indicia 12. Each contact area 16 is in registration with a corresponding indicia 12 on first layer 10. Conductors or leads 18 terminate in a tail portion 20 which extends from the switch assembly for connection with a printed circuit board (not shown) which is part of the device being controlled by the switch assembly.

A third layer 22 of flexible plastic is adjacent second layer 14. Third layer 22 carries a printed pattern of contact areas 24 on its lower surface. These contact areas are usually formed by a screen printing operation and comprise a graphite composition in a vinyl binder. Contact areas 24 comprise one portion of a normally open switch. Contact areas 24 are joined by conductors 26 in a pattern which is designed to perform a switching function for indicia 12 on first layer 10. Conductors or leads 26 terminate in a tail portion 28 which extends from the switch assembly for connection with a printed circuit board (not shown) which is part of the control circuit.

A fourth layer 30 of a resilient insulating material such as a foam felt is adjacent third layer 22 and includes a plurality of apertures 32 that are spaced so as to be in registration with first layer indicia 12, second layer contact areas 16 and third layer contact areas 24.

A fifth layer 34 is provided which is connected to a part of the grounded chassis of the device being controlled. This layer 34 is conductive and forms one portion of the normally open switch of which contact areas 16 or 24 form the other half.

For certain of indicia 12, as shown in FIG. 2, pressure applied to the indicia area in registration with contact area 16 causes the flexing of first layer 10 and second layer 14. Further, third layer 22 is flexed in the area of contact 24. A preferred configuration of contact area 16 is a circular plate, and a preferred configuration of contact area 24 is a ring having an interior open space with a diameter about equal to that of plate 16. This combination allows contact area 16 to pass through contact area 24 and, together with contact area 24, to contact fifth layer 34. This arrangement gives the potential of joining two switch layer areas to ground with a single indicia compression.

Another possible switching combination of this embodiment of the present invention is to eliminate the third layer contact from the switch 12 arrangement shown in FIG. 2. Such an arrangement includes indicia 11 and second layer contact 17 in FIG. 1. An aperture 23 would be present in third layer 22 of sufficient size to allow contact 17 to pass through. If pressure were applied to indicia 11, only second layer contact 17 would be flexed to contact fifth layer 34. This choice of switch contact design gives the potential of joining only a second layer contact to ground.

Another possible switching combination of this embodiment of the present invention is to eliminate the second layer contact from the switch arrangement shown in FIG. 2. Such an arrangement includes indicia 13 and third layer contact 25 in FIG. 1. The area of second layer 14 in registration therewith is numbered 15 and does not contain a contact area. If pressure were applied to indicia 13, only third layer contact 25 could be flexed to contact fifth layer 34. This choice of switch contact design gives the potential of joining a third layer contact to ground.

The particular switch layers may be joined to each other by an appropriate adhesive. Although the preferred shape of second layer 14 contacts has been described as a circular plate and the preferred shape of third layer 22 contacts has been described as a ring, many other shapes of such contacts could be operable. Such shapes could include three, four or more sided shapes for second layer 14 contacts. The third layer 22 contact could be of any shape to permit second layer 14 contact, where so desired, to pass therethrough to contact the fifth layer. Similarly, apertures 32 of fourth layer 30 could be of any desired shape to allow the desired connection of second or third layer contact areas to pass therethrough.

Figure 4:
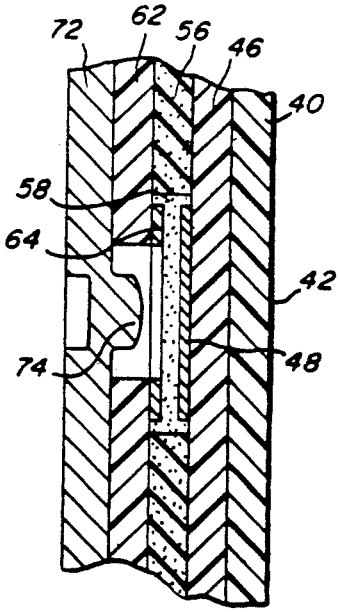
FIG. 4 is a cross section view of a portion of the assembled switch embodiment of FIG. 3.
Figure 3:
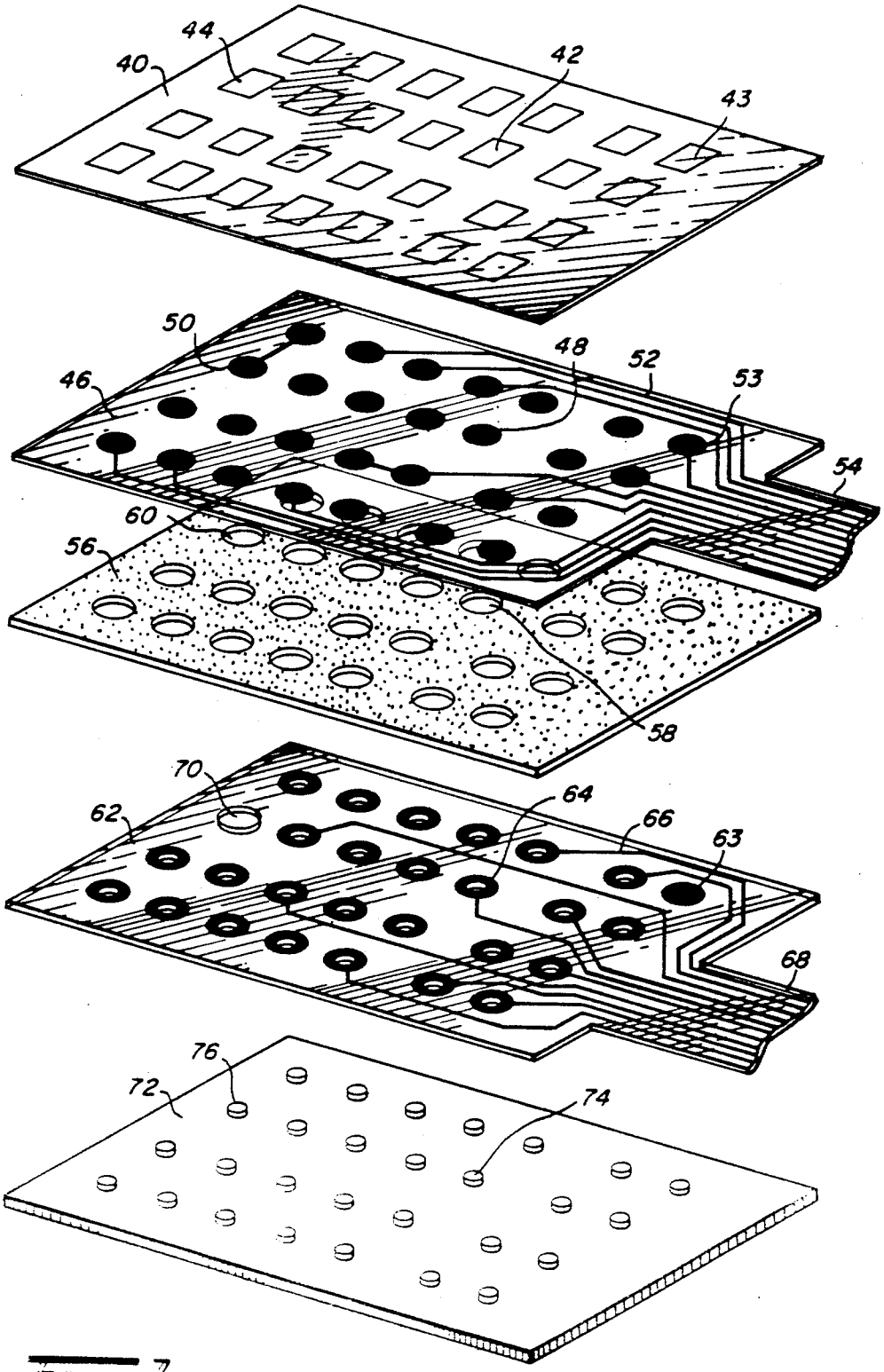
FIG. 3 is an exploded view of a second embodiment of a switch assembly in accordance with the present invention.

Referring now to FIGS. 3 and 4 of the drawings, a membrane switch assembly comprising a second embodiment of the present invention is shown. A first flexible plastic layer 40 is shown comprising several indicia 42. Such indicia identify the switch function that will be accomplished by the pressing of that area of first layer 40.

A second layer 46 of flexible plastic is adjacent first layer 40. Second layer 46 carries a printed pattern of contact areas 48 on its lower surface. These contact areas are usually formed by a screen printing operation and comprise a graphite composition in a vinyl binder. Contact areas 48 comprise one portion of a normally open switch and are joined by conductors 52 in a pattern which is designed to perform the necessary switching function for each indicia. Each contact area 48 is in registration with a corresponding indicia 42 on first layer 40. Conductors or leads 52 terminate in a tail portion 54 which extends from the switch assembly for connection with a printed circuit board (not shown) which is part of the control circuit.

A third layer 56 of a resilient insulating material such as a foam felt is adjacent second layer 46. Third layer 56 includes a plurality of apertures 58 that are spaced so as to be in registration with first layer indicia 42 and second layer contact areas 48.

A fourth layer 62 of flexible plastic is adjacent third layer 56 and carries a printed pattern of contact areas 64 on its upper surface. These contact areas are usually formed by a screen printing operation and comprise a graphite composition in a vinyl binder. Contact areas 64 comprise one portion of a normally open switch. Contact areas 64 are joined by conductors 66 in a pattern which is designed to perform the necessary switching function for each indicia 42 on first layer 40. Conductors or leads 66 terminate in a tail portion 68 which extends from the switch assembly for connection with a printed circuit board (not shown) which is part of the control circuit.

A fifth layer 72 is provided which is connected to or part of the grounded chassis of the device being controlled. Fifth layer 72 is conductive and forms one portion of the normally open switch of which contact areas 48 or 64 form the other portion. Layer 72 may contain raised areas 74 in registration with apertures 58 designed to control the activation pressure of indicia 42 in causing the contact of contact area 48 with raised area 74 of fifth layer 72.

For certain of indicia 42, as shown in FIG. 4, pressure applied to the indicia area in registration therewith causes the flexing of first layer 40 and second layer 46. A preferred configuration of contact area 48 is a circular plate, and a preferred configuration of fourth layer contact area 64 is a ring of a diameter approximately equal to plate 48. This combination allows contact area 48 to contact area 64 and when so joined with contact area 64 to contact fifth layer raised section 74. This arrangement gives the potential of joining two separate switch layer contact areas to ground with a single indicia compression.

Another possible switching combination of this embodiment of the present invention is to eliminate the fourth layer contact from the switch arrangement shown in FIG. 4. Such an arrangement includes second layer contact 50 and indicia 44 shown in FIG. 3. An aperture 70 would be required in fourth layer 62 of sufficient size to allow contact 50 to pass through. If pressure were applied to indicia 44, only second layer contact 50 could be flexed to contact raised section 76 of fifth layer 72. This choice of switch contact design gives the potential of joining only a second layer contact to ground.

Another possible switching combination of this embodiment of the present invention is to eliminate the fifth layer contact from the switch arrangement shown in FIG. 4. Such an arrangement includes indicia 43, second layer contact 53 and fourth layer contact 63 shown in FIG. 3. Note that fourth layer contact 63 is solid and does not include a center aperture to permit contact of a second layer contact with fifth layer 72. If pressure were applied to indicia 43, second layer contact 53 would contact fourth layer contact 63. This choice of switch contact design gives the potential of joining a second layer contact to a fourth layer contact.

The particular switch layers may be joined to each other by an appropriate adhesive. Although the preferred shape of second layer contacts 48 has been described as a circular plate and the preferred shape of fourth layer contacts 64 has been described as a ring, many other shapes of such contacts would be operable. Such shapes could include three, four or more sided shapes for the second layer contacts. Fourth layer 64 contacts could be of any shape provided that a centrally located opening therein permits raised section 74 of fifth layer 72 to contact area 48 of second layer 46. Similarly, apertures 58 of third layer 56 can be of any desired shape to accommodate contact areas 48 of second layer 46 and contact area 64 of fourth layer 62.

Figure 6:
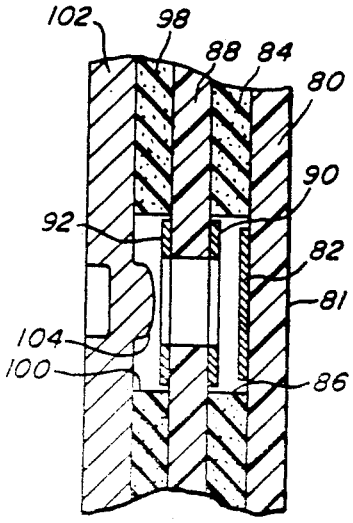
FIG. 6 is a cross section view of a portion of the assembled switch embodiment of FIG. 5.
Figure 5:
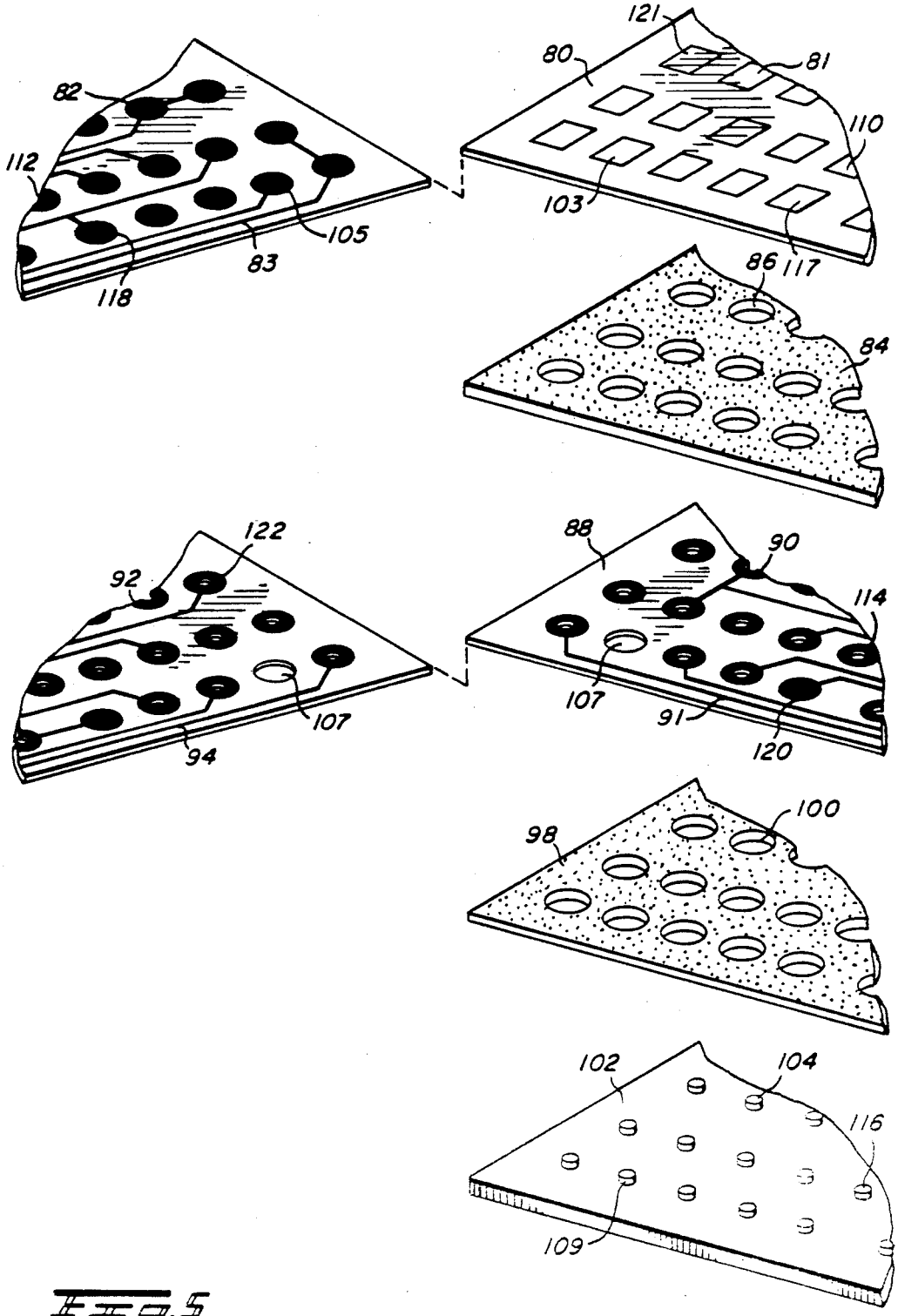
FIG. 5 is an exploded view of a third embodiment of a switch assembly in accordance with the present invention.

Referring now to FIGS. 5 and 6 of the drawings, a membrane switch assembly comprising a third embodiment of the present invention is shown. A first flexible plastic layer 80 is shown comprising several indicia 81 on its upper surface. Such indicia identify the switch function that will be accomplished by pressing the corresponding area of first layer 80. First layer 80 also carries a plurality of corresponding contact areas 82 on its lower surface. These contact areas form a printed pattern usually formed by a screen printing operation and comprise a graphite composition in a vinyl binder. Contact areas 82 comprise one portion of a normally open switch and are joined by conductors 83 in a pattern which is designed to perform a switching function for indicia 81 on the first layer. Each contact area 82 is in registration with a corresponding indicia 81 on the upper surface of first layer 80. Conductor leads terminate in a tail portion which extends from the switch assembly for connection with a printed circuit board (not shown) which is part of the control circuit.

A second layer 84 of a resilient insulating material such as a foam felt is adjacent first layer 80. Second layer 84 includes a plurality of apertures 86 that are spaced so as to be in registration with first layer indicia 81.

A third layer 88 of flexible plastic is adjacent second layer 84 and carries a printed pattern of contact areas 90 on its upper surface. Third layer 88 also carries a printed pattern of contact areas 92 on its lower surface. Upper surface contact areas 90 and lower surface contact areas 92 are electrically isolated from each other by the insulation of the plastic material of third layer 88. These contact areas are usually formed by a screen printing operation and comprise a graphite composition in a vinyl binder. Contact areas 90 and 92 each form one portion of a normally open switch. Contact areas 90 are joined by conductors 91 in a pattern which is designed to perform a switching function for indicia 81 on first layer 80. Contact areas 92 are joined by conductors 94 in a pattern which is designed to perform switching function for indicia 81 on first layer 80. Conductors on leads 91 terminate in a tail portion which extends from the switch assembly for connection with a printed circuit board (not shown) which is part of the control circuit. Conductors on leads 94 terminate in a tail portion which extends from the switch assembly for connection with a printed circuit board (not shown) which is part of the control circuit.

A fourth layer 98 of a resilient insulating material such as foam felt is adjacent third layer 88. Fourth layer 98 includes a plurality of apertures 100 that are spaced so as to be in registration with first layer indicia 81 and contacts 82 and third layer contacts 90 and 92.

A fifth layer 102 is provided which is connected to or part of the grounded chassis of the device being controlled. Fifth layer 102 is conductive and forms one portion of the normally open switch of which contact areas 82, 90 or 92 form the other portion. Fifth layer 102 may contain raised areas 104 in registration with apertures 100 designed to control the activation pressure of indicia 81 in causing the contact of contact area 82 with raised area 104 of fifth layer 102.

For certain of indicia 81, as shown in FIG. 6, pressure applied to the indicia area in registration with contact area 82 causes the flexing of first layer 80. Further, third layer 88 is flexed in the area of contacts 90 and 92. A preferred configuration of contact area 82 is a circular plate, and a preferred configuration of contact areas 90 and 92 is a ring of an outer diameter approximately equal to the diameter of plate 82. This arrangement allows contact area 82 to contact contact area 90 and to cause contact 92 to contact fifth layer 102. Simultaneously, contact area 82 contacts raised section 104 of fifth layer 102. This arrangement gives the potential of joining areas of three switch layers to ground with a single indicia compression.

Another possible switching combination of this embodiment of the present invention is to eliminate the third layer upper and lower contacts from the switch arrangement shown in FIG. 6. Such an arrangement would include indicia 103 and contact area 105 on first layer 80. An aperture 107 would be required in third layer 88 of sufficient size to allow contact 105 to contact raised section 109 of fifth layer 102. If pressure were applied to indicia 103, first layer contact 105 would contact raised section 109 of fifth layer 102. This choice of switch contact design gives the potential of joining only a first layer contact to ground.

Another possible switching arrangement of this embodiment of the present invention is to eliminate the contact area on the lower surface of third layer 88 from the switch arrangement shown in FIG. 6. Such an arrangement would include indicia 110 and contact area 112 on first layer 80. Contact area 114 is present on the upper surface of third layer 88 and is of a configuration to permit contact between contact areas 112 and 114 and to permit contact area 112 to contact fifth layer raised section 116 through an aperture in contact area 114 upon the compression of indicia 110. This choice of switch contact design gives the potential of joining a first layer contact to an upper surface third layer contact and both such contacts to ground.

Another possible switching arrangement of this embodiment of the present invention is to eliminate the contact area on the lower surface of third layer 88 from the switch arrangement shown in FIG. 6 and to eliminate the aperture in the third layer upper contact. Such an arrangement includes indicia 117 and contact area 118 on first layer 80. Contact area 120 is present on the upper surface of third layer 88 and is of a configuration to prohibit contact between contact area 118 and fifth layer 102. This is best accomplished by providing contact 120 in a solid plate shape without an aperture. Upon the compression of indicia 117, first layer contact 118 and third layer upper surface contact 120 contact each other. This choice of switch contact design gives the potential of joining a first layer contact to an upper surface third layer contact.

Another possible switching arrangement of this embodiment of the present invention is to eliminate the contact on the first layer lower surface and the corresponding contact on the upper surface of the third layer from the arrangement shown in FIG. 6. Referring to FIG. 5, such an arrangement would include indicia 121 and third layer lower surface contact 122. Upon the compression of indicia 121, third layer lower surface contact 122 would contact fifth layer 102. This choice of switch contact design gives the potential of joining a third layer lower surface contact to ground.

The particular switch layers may be joined to each other by an appropriate adhesive. Although the preferred shape of first layer 80 lower surface contacts has been described as a circular plate and the preferred shape of most third layer 88 upper and lower surface contacts has been described as a ring, many other shapes of such contacts would be operable. Such shapes include three, four or more sided shapes for the first layer 80 contacts. Third layer 88 contacts could be of any shape provided that a centrally located opening therein permits a raised section 104 of fifth layer 102 to contact the corresponding lower surface contact of first layer 80 when such contact is desired. Similarly, referring to FIG. 6, aperture 86 of second layer 84 and apertures 100 of fourth layer 98 can be of any desired shape to accommodate contacts of the first and third layers as necessary to permit contact with each other and with the fifth layer as desired.

What is claimed is:

1. A membrane switch assembly comprising a flexible first layer, a second layer having a plurality of contacts, a third layer having a plurality of contacts, certain of said third layer contacts being in registration with at least a portion of said second layer contacts, and a fourth layer having at least one contact area, certain of said third layer contacts being of a configuration so as to permit contact between each such third layer contact, a second layer contact in registration therewith and the fourth layer contact area when an area of said flexible first layer in registration with said second and third layer contacts is compressed.

2. The membrane switch assembly of claim 1 wherein certain of said second layer contacts not in registration with a corresponding third layer contact can contact said fourth layer contact area when an area of said first layer in registration with any such second layer contact is compressed.

3. The membrane switch assembly of claim 1 wherein certain of said third layer contacts not in registration with a corresponding second layer contact can contact said fourth layer contact area when an area of said first layer in registration with any such third layer contact is compressed.

4. The membrane switch assembly of claim 1 wherein said second layer contacts are on the lower surface of said second layer and are of a generally circular configuration, and said third layer contacts are on the lower surface of said third layer and are of a ring-like configuration to permit the second layer contacts to pass therethrough and thereby contact said fourth layer while also contacting said third layer contacts.

5. The membrane switch assembly of claim 1 wherein said first layer comprises a plastic material and bears indicia information.

6. The membrane switch assembly of claim 1 wherein said fourth layer comprises a metal chassis plate.

7. The membrane switch assembly of claim 1 wherein said second layer contacts and said third layer contacts are comprised of a carbon base material.

8. The membrane switch assembly of claim 1 wherein said second layer contacts are connected to a first series of leads extending from said switch assembly and said third layer contacts are connected to a second series of leads extending from said switch assembly.

9. A membrane switch assembly comprising a flexible first layer, a second layer adjacent said first layer, said second layer having a plurality of contacts on its lower surface, a third layer adjacent said second layer, said third layer having a plurality of apertures certain of which are in registration with said contacts on the lower surface of the second layer, a fourth layer adjacent said third layer, said fourth layer having a plurality of contacts on its upper surface, certain of said fourth layer contacts being in registration with at least a portion of the contacts on the lower surface of the second layer, said fourth layer also including apertures in registration with certain of the contacts on the lower surface of the second layer, and a fifth layer having at least one contact area on its upper surface, said fourth layer contacts being of a configuration so as to permit each second layer contact in registration therewith to contact said fifth layer contact area while also contacting the fourth layer contact in registration therewith when an area of said flexible first layer in registration with any such second and fourth layer contact is compressed.

10. The membrane switch assembly of claim 9 wherein certain of said second layer contacts not in registration with a corresponding fourth layer contact can contact said fifth layer contact area when an area of said first layer in registration with any such second layer contact is compressed.

11. The membrane switch assembly of claim 9 wherein said second layer contacts are of a generally circular configuration, and said fourth layer contacts are of a ringlike configuration to permit contact between said second layer contacts and said fifth layer while any such second layer contacts are also in contact with any of said fourth layer contacts.

12. The membrane switch assembly of claim 9 wherein said fifth layer contact area has raised portions in registration with the apertures in said fourth layer.

13. The membrane switch assembly of claim 9 wherein said second layer contacts are connected to a series of leads extending from said switch assembly and said fourth layer contacts are connected to a series of leads extending from said switch assembly.

14. A membrane switch assembly comprising a flexible first layer, said first layer having an upper surface and a plurality of first layer contacts on its lower surface, a second layer adjacent said first layer, said second layer having a plurality of apertures in registration with said contacts on the lower surface of the first layer, a third layer adjacent said second layer, said third layer having a plurality of contacts on its upper surface and a plurality of contacts on its lower surface, certain of said third layer upper and lower surface contacts being in registration with said contacts on said first layer, said third layer also including apertures in registration with at least some of said third layer upper and lower surface contacts, a fourth layer adjacent said third layer, said fourth layer having a plurality of apertures in registration with the contacts on the lower surface of said third layer, and a fifth layer having at least one contact area on its upper surface, each of said third layer upper and lower surface contacts being of a configuration so as to permit each first layer contact in registration therewith to contact said fifth layer contact area through the corresponding apertures in said third layer when an area of said first layer upper surface in registration with said first layer contact is compressed.

15. The membrane switch assembly of claim 14 wherein certain of said first layer contacts not in registration with a corresponding third layer upper or lower surface contact can contact said fifth layer contact area when an area of said first layer upper surface in registration with any such first layer contact is compressed.

16. The membrane switch assembly of claim 14 wherein certain of said first layer contacts in registration with a third layer upper surface contact can contact said third layer upper surface contact when an area of said first layer upper surface in registration with any such first layer contact is compressed.

17. The membrane switch assembly of claim 14 wherein certain of said third layer lower surface contacts can contact said fifth layer contact area when an area of said first layer upper surface in registration with any such third layer lower surface contact is compressed.

18. The membrane switch assembly of claim 14 wherein said fifth layer contact area has raised portions in registration with the apertures in said fourth layer.

19. The membrane switch assembly of claim 14 wherein said first layer contacts are connected to a series of leads extending from said switch assembly and said third layer lower surface contacts are connected to a series of leads extending from said switch assembly.

20. The membrane switch assembly of claim 14 wherein said first layer contacts are of a generally circular configuration, said third upper and lower surface contacts are of a ringlike configuration, and said third layer apertures are generally circular and in registration with the ringlike contacts of said third layer upper and lower surfaces to permit contact between each of said first layer contacts with said fifth layer contact area through said third layer apertures while any such first layer contacts also are in contact with any such third layer upper surface contact, and any such third layer lower surface contact is in contact with said fifth layer contact area.

* * * * *

UNITED STATES PATENT AND TRADEMARK OFFICE

CERTIFICATE OF CORRECTION

PATENT NO. : 4,551,586

DATED : November 5, 1985

INVENTOR(S) : Leonard Latasiewicz

It is certified that error appears in the above-identified patent and that said Letters Patent is hereby corrected as shown below:

Claim 20, column 10, line 53, after "third" insert --layer--.

Signed and Sealed this

*Twelfth* Day of *August 1986*

[SEAL]

*Attest:*

DONALD J. QUIGG

*Attesting Officer*

*Commissioner of Patents and Trademarks*